United States Patent [19]

Muraoka

[11] Patent Number: 5,003,609

[45] Date of Patent: Mar. 26, 1991

[54] WHOLE-SURFACE DRIVEN SPEAKER

[75] Inventor: Kazuyuki Muraoka, Akishima, Japan

[73] Assignee: Foster Electric Co., Ltd., Japan

[21] Appl. No.: 308,743

[22] Filed: Feb. 10, 1989

[30] Foreign Application Priority Data

Feb. 15, 1988 [JP] Japan ..... 63-32445
Apr. 1, 1988 [JP] Japan ..... 63-81062

[51] Int. Cl.[5] ..... H04R 9/00; H04R 3/08

[52] U.S. Cl. ..... 381/196; 381/117; 381/176; 381/195; 381/203

[58] Field of Search ..... 381/196, 199, 201, 202, 381/203, 182, 176, 117, 194, 195

[56] References Cited

U.S. PATENT DOCUMENTS 4,471,173 9/1984 Winey ..... 381/203
4,484,037 11/1984 Nieuwendijk et al. ..... 381/159
4,612,420 9/1986 Nieuwendijk et al. ..... 381/196

FOREIGN PATENT DOCUMENTS 0062696 4/1982 Japan ..... 381/202

*Primary Examiner*—Jin F. Ng
*Assistant Examiner*—M. Nelson McGeary, III
*Attorney, Agent, or Firm*—Leydig, Voit & Mayer

[57] ABSTRACT

A whole-surface driven speaker includes first and second support plates having sound-passing perforations and groups of magnets mounted on the plates. The plates are substantially parallel to each other. A diaphragm is disposed in between the plates. A plurality of conductor strips are mounted on the surface of the diaphragm. The strips are connected to receive pulse-code modulated signals. The strips respectively correspond to a plurality of binary bits of the signals of different bit significance. Each strip has a predetermined width and a predetermined number of windings and carries a predetermined current magnitude such that electromechanical forces on the diaphragm caused by the bit signals flowing through the strips are proportional to the respective bit significance of the strips.

4 Claims, 2 Drawing Sheets

FIG. 1
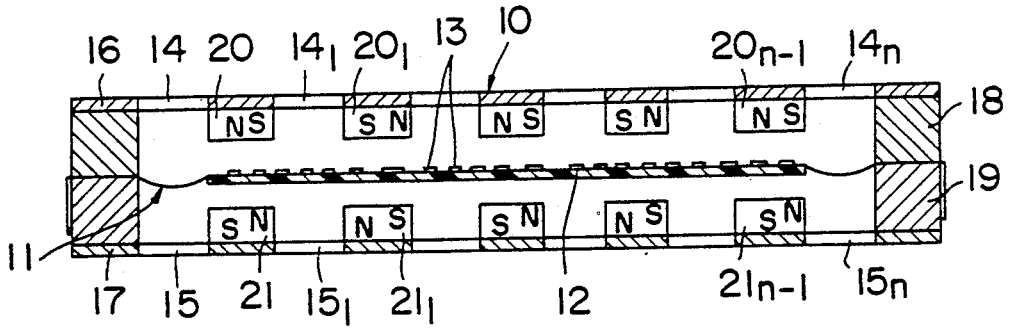
FIG. 2
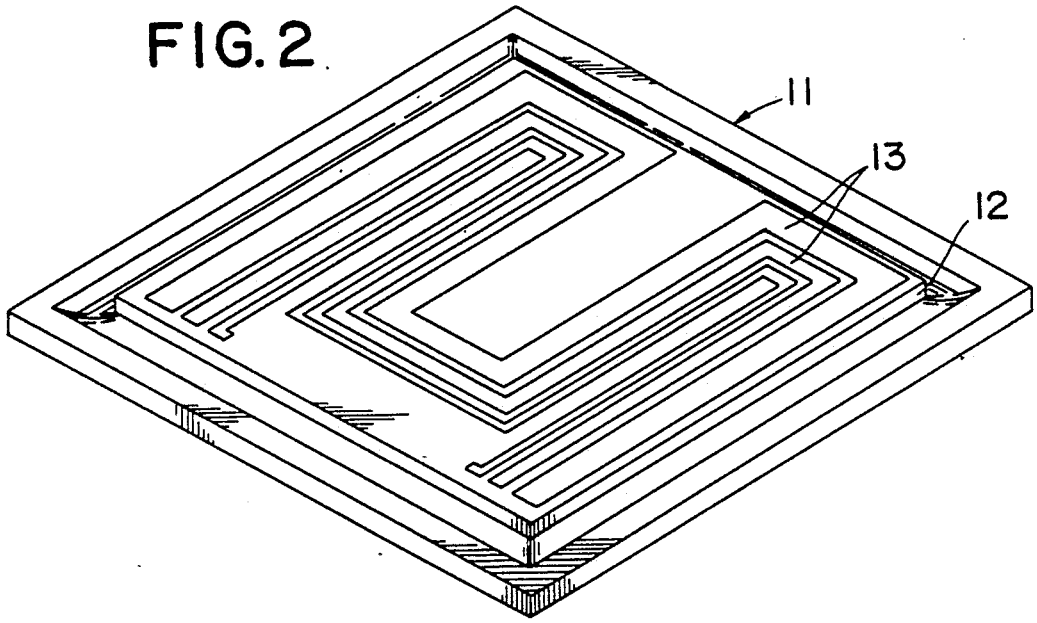
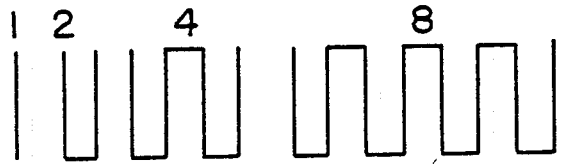
FIG. 3
PRIOR ART
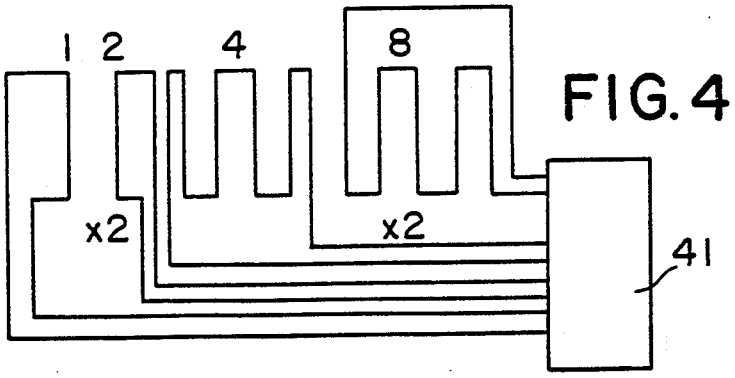
FIG. 4

WHOLE-SURFACE DRIVEN SPEAKER

TECHNICAL BACKGROUND OF THE INVENTION

This invention relates to whole-surface driven speakers in which a diaphragm carrying thereon a strip-shaped coil is disposed between two groups of flatly opposing magnetic pole surfaces of permanent magnets.

The whole-surface driven speakers of the kind referred to can be effectively employed in acoustic apparatus and equipment of a relatively wide frequency band.

DISCLOSURE OF PRIOR ART

There have been suggested various types of whole-surface driven speakers of that kind, an example of which would be the one disclosed in U.S. Pat. No. 3,922,504 to Kenichiro Kishikawa et al. According to this U.S. patent, an electroacoustic transducer comprises a diaphragm having a series of strip-line shaped conductor coil on a sheet of insulating material, and two groups of elongated permanent magnets arranged on both sides of the diaphragm to oppose each other with the same polarity pole faces through the diaphragm but with opposite polarity poles to adjacent ones on each side of the diaphragm. The two groups of permanent magnets are respectively secured to a pair of support plates having sound-passing perforations, and a support member secured to peripheral edges of the diaphragm to support it in a tense state is held between peripheral parts of the support plates to be integrated therewith to form the whole-surface driven speaker. In operation, pulse-code modulated signals are made to flow through the coil on the diaphragm disposed in magnetic fluxes flowing along the plane of the diaphragm between the respective adjacent ones of the permanent magnets, the signals thus cause the diaphragm to be subjected to an electromagnetic force effective in a direction perpendicular to the plane of the diaphragm to vibrate the diaphragm in response to the magnitude of the signals. An audible sound wave thereby generated is provided through the perforations of the support plates.

In the foregoing whole-surface driven speaker of dynamic type, a so-called pulse code modulation system in which acoustic signals are pulse-coded for transmission or recording and reproduction is employed, so that the signals can be made durable against any distortion or recording with an enlarged dynamic range obtained and adaptable to the transmission or multiplex use. It should be readily appreciated here by any skilled in the art that the dynamic range is proportional to bit number increase so that 1 bit increment can increase the range by about 6 dB whereas the distortion is inversely proportional to the bit number increment.

In adopting such pulse code modulation system, it is required to vary the width of conductor strip forming the coil to vary its weight in accordance with a bit signal corresponding to the bit number, i.e., bit significance, of the modulated signal. Because of this requirement there has arisen practical a problem upon increasing the bit number. For example, 8 bits require 256 weight, 9 bits require 512 weight, 10 bits require 1,024 weight and, further, 15 bits require $2^{15}=32,768$ weight. In this respect, it has been made clear that, for acoustic conversion in CD players, in general, the signal is required to be more than 12 bits. If a 16 bit signal is to be employed, its 1 bit will be used for providing positive or negative code so that remaining 15 bits will be elements which receive the weight according to their relative significance, in which first 1 bit is used as "0" or "1" to be of a weight $2^0$, second bit is to be of a weight of $2^1$ and eventually a maximum drive force of $2^{16-1}$ is obtainable. This has caused a problem to arise since required coil windings for such event exceeds 30,000 turns if each turn of the winding is made to correspond to each bit so that the amount of conductor strips forming the coil on the diaphragm is required to be extremely large to eventually enlarge the diaphragm and the entire speaker size as well.

SUMMARY OF THE INVENTION

A primary object of the present invention is, therefore, to provide a whole-surface driven speaker capable of remarkably reducing the strip conductor amount on the diaphragm, i.e., the space factor of the coil, and thus contributing to the entire speaker size minimization.

Another object of the present invention is to provide a whole-surface driven speaker in which the diaphragm comprises divided vibration members which are joined into a laminate, so that the diaphragm as well as the entire speaker can be minimized in size.

Still another object of the present invention is to provide a whole-surface driven speaker in which the diaphragm is formed by inserting a foamed mica plate between the divided vibration members, so that the strength of the diaphragm can be increased.

According to the present invention, these objects can be attained by providing a whole-surface driven speaker which comprises a diaphragm including a sheet of insulating material. A coil of conductor strips is formed on the sheet for receiving pulse-code modulated acoustic signals. The signals correspond to binary bits of different bit significance. The coils carry varying current magnitudes and vary in number of coils and width in accordance with the significance of the pulse-code modulated signals. Two groups of magnet members are disposed respectively on support plates having sound-passing perforations on both sides of the diaphragm spaced therefrom and as opposed to one another. Thus, the speaker produces sound according to the bit significance of the pulse-code modulated signals based both on the dimension of the coil strips and the magnitude of signals supplied to the coil strips.

Other objects and advantages of the present invention shall be made clear in following explanation of the invention detailed with reference to preferred embodiments shown in accompanying drawings.

BRIEF EXPLANATION OF THE DRAWINGS

FIG. 1 is a sectioned view of a whole-surface driven speaker in an embodiment according to the present invention;

FIG. 2 is a perspective view of a diaphragm employed in the speaker of FIG. 1;

FIG. 3 is an explanatory view for strip-shaped conductor patterns in known diaphragm;

FIG. 4 is an explanatory view for strip-shaped conductor patterns in an practical aspect of the diaphragm according to the present invention;

Figure 5:
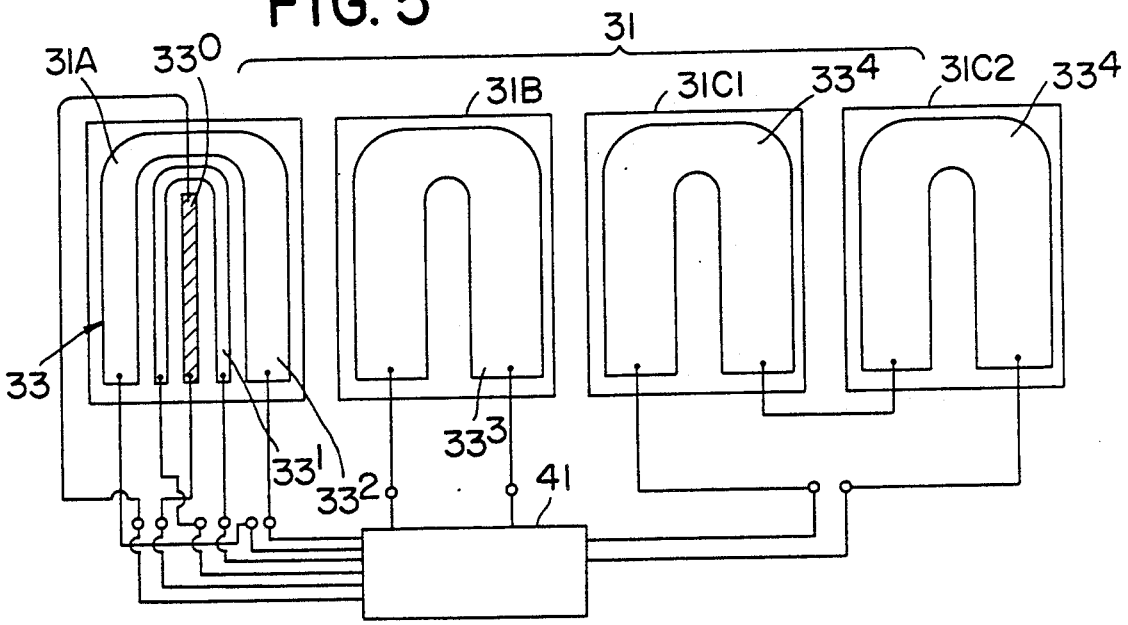
FIG. 5 is a schematic plan view as developed of a diaphragm in another embodiment of the present invention.

While the present invention shall now be elucidated with reference to such embodiments shown in the accompanying drawings, it should be appreciated that the intention is not to limit the invention only to these embodiments shown, but rather to include all alterations, modifications and equivalent arrangements possible within the scope of appended claims.

DISCLOSURE OF PREFERRED EMBODIMENTS

Referring to FIGS. 1 and 2, a whole-surface driven speaker 10 in an embodiment according to the present invention comprises a diaphragm 11 which is formed with a sheet of an insulating material, preferably a plastic film 12, and a coil 13 of a pattern of conductor strips formed on the film 12 by means of gluing, printing, etching or the like. On both sides of this diaphragm 11, there are disposed two support plates 16 and 17 respectively having the same number of sound-passing perforations 14, $14_1$, . . . $14_n$ and 15, $15_1$, . . . $15_n$ slightly separated from the diaphragm 11 and parallel with one another. The support plates 16 and 17 are integrated with the diaphragm 11 through two halves 18 and 19 of a rectangular frame-shaped supporter, the supporter halves 18 and 19 holding between them peripheral edges of the diaphragm 11 and securing peripheral parts of the plates 16 and 17 while separating them in parallel from the diaphragm 11.

Onto mutually opposing surfaces of the support plates 16 and 17, or their inner surface on the side facing the diaphragm 11, respectively, there is secured each of two groups of permanent magnets 20, $20_1$, . . . $20_{n-1}$ and 21, $21_1$, . . . $21_{n-1}$ of the same number. In the present instance, the sound-passing perforations 14, $14_1$, . . . $14_n$ and 15, $15_1$, . . . $15_n$ made in the support plates 16 and 17 lie in the same direction as that in which substantial elongated parts of the coil 13 extend and to be mutually in parallel. The permanent magnets 20, $20_1$, . . . $20_{n-1}$ or 21, $21_1$, . . . $21_{n-1}$ are of an elongated bar-shape and secured to the support plate 16 or 17 respectively between adjacent ones of the perforations 14, $14_1$, . . . $14_n$ or 15, $15_1$, . . . $15_n$ to extend in the same direction as the substantial elongated strip parts of the coil 13 to be mutually in parallel (FIG. 1 showing only six sound-passing perforations and five permanent magnets for each group). Further, these two groups of the permanent magnets 20, $20_1$, . . . $20_{n-1}$ and 21, $21_l$, . . . $21_{n-1}$ are so arranged that their pole surfaces opposing through the diaphragm 11 will be of the same polarity, but will be of an opposite polarity to adjacent ones on each side of the diaphragm 11 so that, when a first opposing pair of the magnets 20 and 21 oppose with their N pole surfaces, then a next opposing pair of the magnets $20_l$ and $21_l$ oppose with their S pole surfaces.

In the whole-surface driven speaker 10 of the above arrangement, the pulse-code modulated signals into which acoustic signals are pulse-coded are supplied from a power supply or a pre-main amplifier shown as 41 in FIGS. 4 and 5 to the coil 13 on the diaphragm 11 to flow therethrough. The coil, 13 which is already in an influence of magnetic force of the opposing permanent magnets 20, $20_1$, . . . $20_{n-1}$ and 21, $21_1$, . . . $21_{n-1}$, is caused to vibrate together with the film 12 of the diaphragm 11 at a frequency responsive to the magnitude of electric current of the supplied signal, and a corresponding audible sound wave is provided out of the perforations 14, $14_1$, . . . $14_n$ and 15, $15_1$, . . . $15_n$ in the support plates 16 and 17.

The driving force of the whole-surface driven speaker is proportional to Bli, in which B is the flux density, l is the effective length of the coil 13, and i denotes the current flowing through the coil, and such elements of Bli are so set as to correspond to the bit number or bit significance of the pulse-code modulated signals. If the bit number of the pulse-code modulated signals is set, for example, to be 16 bits with first 1 bit employed for positive and negative code provision, then the driving force should reach such large number as 32,768 as has been partly referred to. If the weight of 32,768 is supplied to the coil 13 by providing one turn of the coil winding for each bit, the coil 13 should be required to have windings of 32,768 turns. Since the required number of strip-shaped conductors on the diaphragm 11 are so large and require so much space, the size of the entire speaker according to the prior art is increased.

According to a unique feature of the present invention, however, the coil 13 is made to vary the weight by varying the width of the turns, the number of winding turns, and also the element i in Bli. The electric current amount from the power supply 41 made to flow through the coil 13 is also varied independently of the width and number of turns. The values of these three parameters are selected according to the bit significance, i.e., bit number. As a consequence, the relative weight of the electromechanical force on the diaphragm 11 resulting from the pulse code modulated signal is borne also by the power supply side due to the current variation produced by the power supply 41. By increasing the current, the number of winding turns of the coil 13 and the width of the turns can be remarkably decreased in proportion to render the size of the diaphragm 11 smaller, and an effective minimization in size of the entire speaker can be realized.

FIG. 3 shows a known strip conductor pattern for the known coil in which the number of winding turns has to be sequentially increased as the bit number increases. The bit number as well as the winding number are shown to increase from 1 to 8. A strip conductor pattern according to the present invention is shown in FIG. 4 which also shows 8 bits. The windings corresponding to first and second bits are formed to be identical to each other, but the electric current amount fed to the second bit winding from a power supply 41 is made double, and the windings corresponding to fourth bit and eighth bit are also formed identically but the current amount fed to the eighth bit winding is doubled (shown by "x2" in FIG. 4). Thus, the current is varied independently of the number and width of windings. An example of weight distribution ratio will be as shown in TABLE I:

TABLE I

| Bit Number | Strip Condor Amount on Diaphragm (Winding Turn Number) | Supplied Power Amount | Driving Force |
|---|---|---|---|
| $2^0$ | 1 | 1 | 1 |
| $2^1$ | 1 | 2 | 2 |
| $2^2$ | 4 | 1 | 4 |
| $2^3$ | 4 | 2 | 8 |

In the above connection, it has been found that the area ratio of the amount of strip conductors formed on the diaphragm 11 according to the present invention with respect to that of prior art conductors such as shown in FIG. 3 is 199:511 so long as the conductors in both cases are of the same width, and that the strip conductor amount on the diaphragm 11 according to the present invention is about 39% of that on a prior art diaphragm. Similarly, the area ratio of the strip conductor amount between the diaphragms prepared according to the present invention so as to correspond to the signals of 16 bits and the known manner has been 12,871:1,310,711 for 16 bits. Accordingly, the strip conductor amount according to the present invention is about 9.8% of that of the known manner. An example of the weight distribution ratio in this case of 16 bits will be as shown in TABLE II:

TABLE II

| Bit Signal | Strip Conductor Amount on Diaphragm (Winding Turn Number) | Supplied Power Amount | Driving Force |
|---|---|---|---|
| $2^0$ | 1 | 1 | 1 |
| $2^1$ | 1 | 2 | 2 |
| $2^2$ | 2 | 2 | 4 |
| $2^3$ | 4 | 2 | 8 |
| $4^4$ | 8 | 2 | 16 |
| $2^5$ | 16 | 2 | 32 |
| $2^6$ | 32 | 2 | 64 |
| $2^7$ | 64 | 2 | 128 |
| $2^8$ | 128 | 2 | 256 |
| $2^9$ | 256 | 2 | 512 |
| $2^{10}$ | 512 | 2 | 1024 |
| $2^{11}$ | 1028 | 2 | 2048 |
| $2^{12}$ | 2048 | 2 | 4096 |
| $2^{13}$ | 4096 | 2 | 8192 |
| $2^{14}$ | 8192 | 2 | 16384 |
| $2^{15}$ | 16384 | 2 | 32768 |

In providing the weight, the distribution ratio of the diaphragm's strip conductor amount and the supplied power amount may be set as properly modified. For example, the supplied power amount may be made 1 for the first bit, 2 times for second to eighth bits and 4 times for following bits, in which event the pattern will be as in TABLE III:

TABLE III

| Bit Signal | Strip Conductor Amount on Diaphragm (Winding Turn Number) | Supplied Power Amount | Driving Force |
|---|---|---|---|
| $2^0$ | 1 | 1 | 1 |
| $2^1$ | 1 | 2 | 2 |
| $2^2$ | 2 | 2 | 4 |
| $2^3$ | 4 | 2 | 8 |
| $2^4$ | 8 | 2 | 16 |
| $2^5$ | 16 | 2 | 32 |
| $2^6$ | 32 | 2 | 64 |
| $2^7$ | 64 | 2 | 128 |
| $2^8$ | 64 | 4 | 256 |
| $2^9$ | 128 | 4 | 512 |
| $2^{10}$ | 256 | 4 | 1024 |
| $2^{11}$ | 512 | 4 | 2048 |
| $2^{12}$ | 1024 | 4 | 4096 |
| $2^{13}$ | 2048 | 4 | 8192 |
| $2^{14}$ | 4096 | 4 | 16384 |
| $2^{15}$ | 8192 | 4 | 32768 |

Consequently, it is made possible to reduce the number of winding turns in the strip conductor pattern for the eighth bit to be 64 and that for the sixteenth bit to be 8192, and thus to remarkably reduce the space factor of the strip conductors on the diaphragm 11.

Further, the supplied power amount can be made 1 for first bit, 2 times for second to eighth bits, 4 times for nineth to twelveth bits, and 8 times for thirteenth to sixteenth bits, and the weight distribution ratio in this case will be as in TABLE IV:

TABLE IV

| Bit Signal | Strip Conductor Amount on Diphragm (Winding Turn Number) | Supplied Power Amount | Driving Force |
|---|---|---|---|
| $2^0$ | 1 | 1 | 1 |
| $2^1$ | 2 | 1 | 2 |
| $2^2$ | 4 | 1 | 4 |
| $2^3$ | 8 | 1 | 8 |
| $2^4$ | 8 | 2 | 16 |
| $2^5$ | 16 | 2 | 32 |
| $2^6$ | 32 | 2 | 64 |
| $2^7$ | 64 | 2 | 128 |
| $2^8$ | 64 | 4 | 256 |
| $2^9$ | 128 | 4 | 512 |
| $2^{10}$ | 256 | 4 | 1024 |
| $2^{11}$ | 512 | 4 | 2048 |
| $2^{12}$ | 512 | 8 | 4096 |
| $2^{13}$ | 1024 | 8 | 8192 |
| $2^{14}$ | 2048 | 8 | 16384 |
| $2^{15}$ | 4096 | 8 | 32768 |

Thus, it should be appreciated that the winding turn number at the sixteenth bit in the strip conductor pattern according to the present invention can be reduced to 4096 so that the space factor of the conductor strip can be further reduced.

Such reduction of the conductor strip amount, that is, the winding turn number on the diaphragm 11, also results in a reduction in the area of the strip conductor windings other than that driven by the pulse-code modulated signals so that any reverse electromotive force which has been generated in these windings can be also reduced to allow any measure for the reverse withstand voltage on the power supply side to be simplified.

Figure 6:
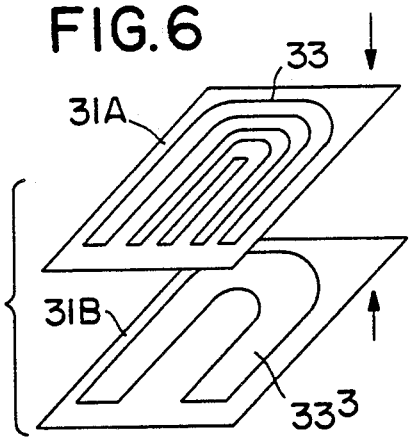
FIG. 6 is an explanatory view for assembling manner of the diaphragm shown in FIG. 5.
Figure 7:
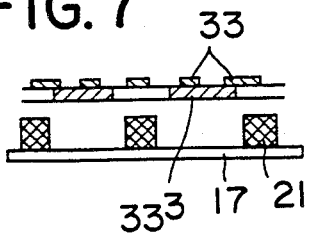
FIG. 7 is a fragmentary sectioned view of a speaker in which the diaphragm of FIG. 5 is employed.

According to another feature of the present invention, a plurality of divided vibration members are prepared and joined into a laminate in order to minimize the size of the diaphragm. Referring to FIGS. 5 to 7, a diaphragm 31 in the present embodiment comprises a plurality of divided vibration members 31A, 31B, 31C1 and 31C2 onto which strip conductor windings forming respectively a part of a coil 33 are provided by a suitable means such as gluing, printing, or etching. On the first divided vibration member 31A, there are provided a strip conductor winding $33^0$ corresponding to the first $2^0$ bit, a similar winding $33^1$ corresponding to the second $2^1$ bit and another similar winding $33^2$ corresponding to the third $2^2$ bit. The second divided vibration member 31B has a conductor strip winding $33^3$ corresponding to the fourth $2^3$ bit, while these first and second divided vibration members 31A and 31B have the same dimensions. The remaining divided vibration members 31C1 and 31C2 each have the same dimensions as the first and second divided vibration members 31A and 31B so that, in an event where strip conductor windings $33^4$ corresponding to the fifth $2^4$ bit cannot be provided on the members 31A and 31B due to lack of surface area, the winding $33^4$ may be provided as divided on these members 31C1 and 31C2.

In FIG. 5, there are shown only four of the divided vibration members. The strip conductor windings 33 corresponding to the $2^5$ through $2^{15}$ bits may be prepared, if required, as divided into a plurality of divided vibration members as has been shown as an example with reference to the divided vibration members 31C1 and 31C2. It will be also appreciated that, while the foregoing description has been made to explain that the divided vibration member 31A is provided with the strip conductor windings $33^0$, $33^1$ and $33^2$ corresponding to the $2^0$, $2^1$ and $2^2$ bits, the divided vibration member 31B with the winding $33^3$ corresponding to the $2^3$ bit and the remaining divided vibration members 31C1 and 31C2 with the windings $33^4$, the first divided vibration member 31A, for example, may be prepared to carry the strip conductor windings corresponding to the $2^0$ to $2^5$ bits and the second divided vibration member 31B to carry the strip conductor windings corresponding to the $2^6$ to $2^8$ bits, respectively. More generally, the strip conductor windings provided on the divided vibration members may properly be modified in the configuration or increased or decreased in number to realize an optimum dimensional minimization.

In an event where the diaphragm 31 carrying the coil 33 as strip-shaped and corresponding to the $2^0$ to $2^3$ bits, for example, is to be prepared, the particular diaphragm can be completed by stacking the first and second divided vibration members 31A and 31B as shown in FIG. 6, the strip conductor windings are optimally provided with the weight as will be clearly seen in FIG. 7, and the same operation as that of the whole-surface driven speaker as has been shown in FIGS. 1 and 2 can be realized.

Figure 8:
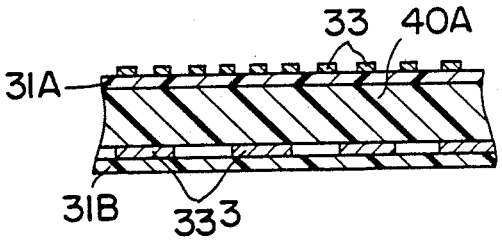
FIGS. 8 and 9 are fragmentary sectioned views respectively of a diaphragm in still another embodiment according to the present invention.
Figure 9:
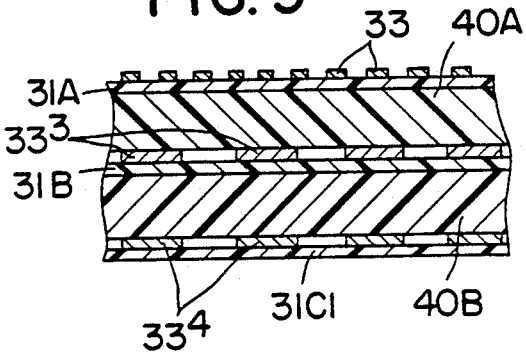

In stacking the divided vibration members 31A, 31B, 31C1, 31C2, . . . to be joined into a laminate, it may be possible to have the diaphragm 31 provided with a sufficient rigidity by interposing between the respective divided vibration members foamed mica plates 40A and 40B of a sheet shape of, for example, about 0.05 to 0.3 in the specific gravity, as shown in FIG. 8, or in FIG. 9, whereby the diaphragm 31 can be made uniform in the tension so as to be able to prevent any abnormal noise from being generated upon transmitting the audible sound waves.

What is claimed is:

1. A whole-surface driven speaker comprising:

first and second support plates, each having a plurality of sound-passing perforations and disposed substantially parallel to each other;

first and second groups of magnets mounted on said first and second support plates, respectively, each magnet having a North pole and a South pole and oriented such that an axis running through the North and South poles is substantially perpendicular to said first and second support plates, each magnet of said first group being disposed coaxially with a corresponding magnet of said second group to form a pair of magnets, each pair of magnets having the same polarity poles facing each other, the magnets of each of said groups being dispersed over said support plates such that adjacent magnets within said first group have opposite polarity poles facing the corresponding magnets of said second group; and a diaphragm having a plurality of conductor strips disposed thereon, said diaphragm being disposed between said first and second groups of magnets substantially parallel with said first and second support plates and movable in a direction perpendicular thereto, each conductor strip having a predetermined width and a predetermined number of windings, the conductor strips including a first and a second conductor strip having an identical width and an identical number of windings, the conductor strips being connected to receive pulse-code modulated signals corresponding to a plurality of binary bits of different bit significance including a first signal received by the first conductor strip and a second signal received by the second conductor strip, each strip corresponding to a predetermined bit significance, the first and second conductor strips corresponding to bit significance differing by a factor of two;

wherein the predetermined current magnitudes, widths, and numbers of windings have values such that electromechanical forces on said diaphragm caused by said bit signals flowing through said conductor strips are proportional to the corresponding bit significance, and wherein the first signal has twice as much current as the second signal, and the force caused by the first signal is twice as great as the force caused by the second signal.

2. A speaker according to claim 1 wherein said diaphragm comprises a plurality of divided vibration members respectively carrying divided ones of said conductor strips corresponding to respective bits of said signals, said divided vibration members being joined into a laminate.

3. A speaker according to claim 2 wherein at least a foamed mica plate is interposed between said divided vibration members in said laminate.

4. A speaker system including a whole-surface driven speaker, the speaker system comprising:

first and second support plates, each having a plurality of sound-passing perforations and disposed substantially parallel to each other;

first and second groups of magnets mounted on said first and second support plates, respectively, each magnet having a North pole and a South pole and oriented such that an axis running through the North and South poles is substantially perpendicular to said first and second support plates, each magnet of said first group being disposed coaxially with a corresponding magnet of said second group to form a pair of magnets, each pair of magnets having the same polarity poles facing each other, the magnets of each of said groups being dispersed over said support plates such that adjacent magnets within said first group have opposite polarity poles facing the corresponding magnets of said second group;

a diaphragm having a plurality of conductor strips disposed thereon, said diaphragm being disposed between said first and second groups of magnets substantially parallel with said first and second support plates and movable in a direction perpendicular thereto, each conductor strip having a predetermined width and a predetermined number of windings, the conductor strips being connected to receive pulse-code modulated signals corresponding to a plurality of binary bits of different bit significance, each strip corresponding to a predetermined bit significance; and means connected to the conductor strips on said diaphragm for producing pulse-code modulated signals and supplying the signals thereto, the signals including a plurality of bit signals respectively connected to the conductor strips of the corresponding bit significance, each bit signal having a respective predetermined current magnitude, wherein the predetermined current magnitudes, widths, and numbers of windings have values such that electromechanical forces on said diaphragm caused by said bit signals flowing through said conductor strips are proportional to the corresponding bit significance, and wherein, for at least a first conductor strip corresponding to a bit of greater significance and a second conductor strip corresponding to a bit of lesser significance, the product of the predetermined width and number of windings of the first conductor strip is less than or equal to the product of the predetermined width and number of windings of the second conductor strip.

* * * * *